United States Patent [19]

Howorth

[11] 4,094,232

[45] * June 13, 1978

[54] CLEAN AIR ZONE

[75] Inventor: Frederick Hugh Howorth, Chorley, England

[73] Assignee: Howorth Air Engineering Limited, Farnworth, Bolton, England

[ * ] Notice: The portion of the term of this patent subsequent to Mar. 1, 1994, has been disclaimed.

[21] Appl. No.: 758,926

[22] Filed: Jan. 13, 1977

Related U.S. Application Data

[63] Continuation-in-part of Ser. No. 568,614, Apr. 16, 1975, Pat. No. 4,009,647.

[30] Foreign Application Priority Data

May 8, 1976 United Kingdom ..... 19024/76

[51] Int. Cl.[2] ..... F24F 9/00

[52] U.S. Cl. ..... 98/36; 98/40 D; 55/DIG. 29; 128/1 R

[58] Field of Search ..... 98/36, 40 D; 128/1 R; 55/DIG. 29

[56] References Cited

U.S. PATENT DOCUMENTS

| | | | |
|---|---|---|---|
| Re. 25,216 | 8/1962 | Kennedy | 98/40 D |
| 3,151,929 | 10/1964 | Potapenko | 55/DIG. 29 |
| 3,367,257 | 2/1968 | Raider et al. | 98/40 D |
| 3,380,369 | 4/1968 | Allander | 98/36 |
| 3,626,837 | 12/1971 | Pelosi, Jr. | 98/36 |
| 3,631,788 | 1/1972 | Lankfeldt | 98/40 D |
| 3,726,204 | 4/1973 | Lindestrom | 98/36 |
| 3,776,121 | 12/1973 | Truhan | 98/36 |
| 3,803,995 | 4/1974 | Allander | 98/36 |
| 3,824,909 | 7/1974 | Horneff et al. | 98/40 D |
| 4,009,647 | 3/1977 | Howorth | 98/36 |

*Primary Examiner*—John J. Camby
*Assistant Examiner*—Henry C. Yuen
*Attorney, Agent, or Firm*—Ross, Ross & Flavin

[57] ABSTRACT

Apparatus for providing a clean air zone around a patient undergoing surgery or in a pharmaceutical or electronic clean room comprises a plurality of air supply means and a plurality of air delivery means, the air delivery means comprising a central means adapted to supply air at a first velocity and an outer means adapted to supply air at a second lower velocity, the air delivery means having different permeabilities for attaining the desired flow differential.

9 Claims, 4 Drawing Figures

CLEAN AIR ZONE

This is a continuation-in-part of my copending application Ser. No. 568,614 filed Apr. 16, 1975, now U.S. Pat. No. 4,009,647.

FIELD OF THE INVENTION

This invention relates to apparatus for generating a clean air zone, for example around a patient undergoing surgery, to minimise the possibility of the access of bacteria to the wound(s), or in a pharmaceutical or electronic clean room.

PRIOR ART

It is known to create such a zone by supplying sterile air from roof mounted diffusers over an area about three meters square. Such a zone has to have the flowing air enclosed in either side walls, for example solid walls of glass or plastics material, or a curtain of high velocity air. The solid walls have the disadvantage of reducing accessibility and the high speed air curtain has the disadvantage that if the curtain of air is broken, contaminants pass to the low velocity air of the zone. Further, the curtain of high velocity air has the unfortunate effect of creating turbulence and tending to entrain material from the floor of the operating theatre, and from objects and persons passing through the curtain, and mixing them into the clean area.

OBJECT OF THE INVENTION

An object of the present invention is to provide apparatus for producing a clean air zone in which the disadvantages of the known zones are obviated or minimised.

BRIEF STATEMENT OF THE INVENTION

Accordingly the invention provides apparatus for providing a clean air zone comprising:

a plurality of air delivery means, a plurality of air supply means for supplying sterile air to the air delivery means, a first central one of the air delivery means being adapted to supply air at a first velocity, and a second outer one of the air delivery means being adapted to supply air at a second velocity lower than the first velocity, the different air delivery means having different permeabilities for attaining the desired flow velocity differential.

A preferred embodiment of apparatus 10 conforming to the invention is suitable for attachment to the ceiling of an operating theatre to provide a clean air zone around a patient undergoing surgery, or to the ceiling of a pharmaceutical or electronic clean room to provide a clean air zone around a machine or a manufacturing process. Instead of being ceiling mounted, the apparatus could be mounted on a wheeled frame to render it mobile and to enable it to be moved from, say, one machine to another.

Figure 2:
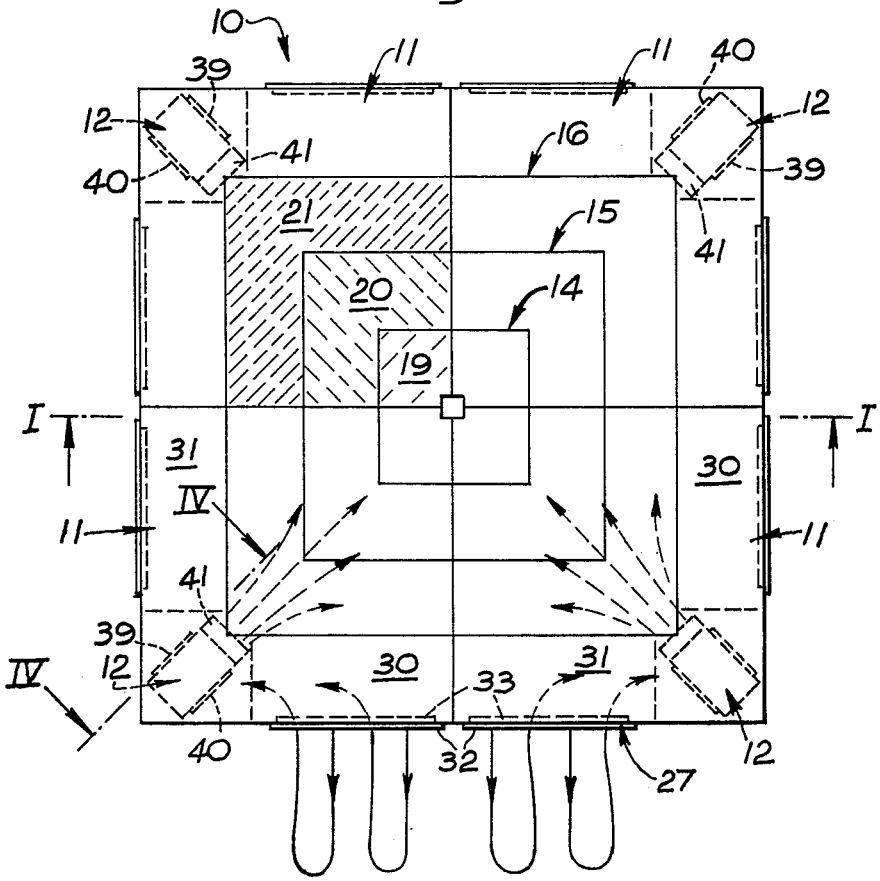
FIG. 2 is an inverted plan view of the apparatus of the invention.
Figure 3:
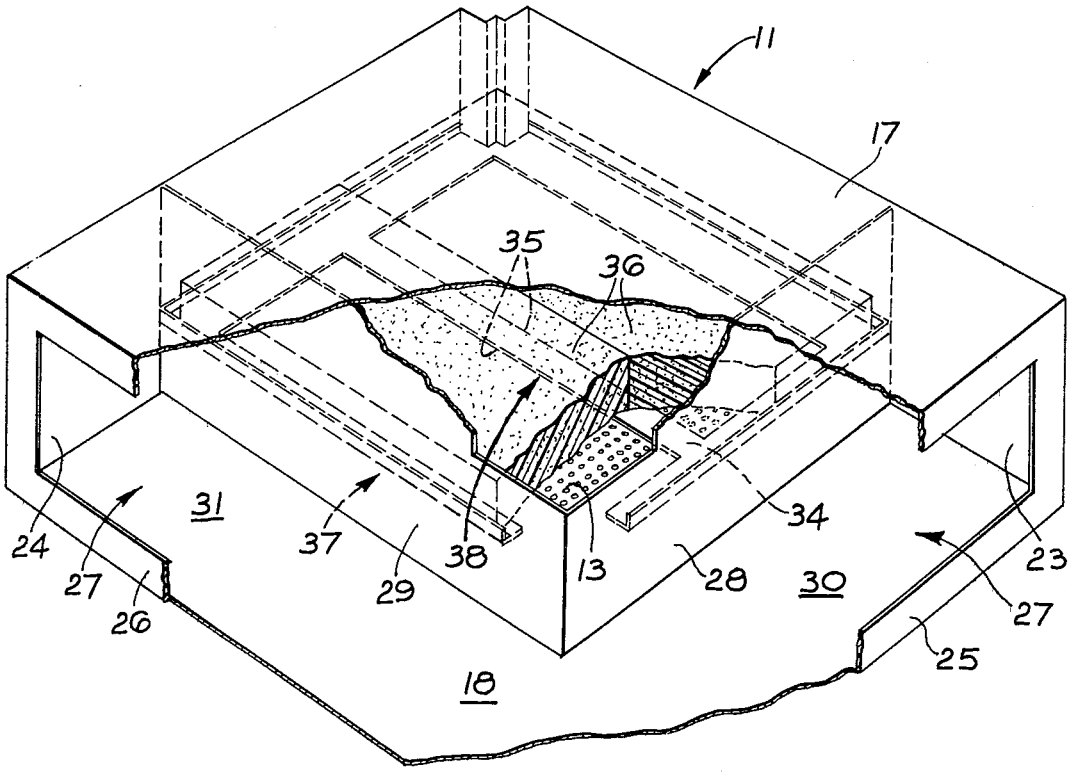
FIG. 3 is a fragmentary perspective cut-away view of one module forming part of the apparatus of the invention, parts having been omitted for clarity.

The apparatus 10 is in the form of a unit constructed from four modules 11, one of which is shown in detail in FIG. 3. Each unit thus has four air supply means constituted by fans 12, and three air delivery means (FIG. 2) constituted by areas of diffuser plates 13 of the modules.

A central one of the air delivery means is in the form of a square panel 14 of relatively high permeability (i.e. it has more and/or larger apertures than the other air delivery means) and in use delivers air at a linear velocity from 90–130 f.p.m, (preferably 110 f.p.m.). A second of the air delivery means is in the form of a panel 15 surrounding panel 14 and so perforated as to deliver air at a linear velocity of 60–90 f.p.m. (preferably 75 f.p.m.). A third of the air delivery means is in the form of a panel 16 surrounding panel 15 and so perforated as to deliver air at a linear velocity of 20–60 f.p.m. (preferably 40 f.p.m.). It must be noted, however, that whilst the velocities of the flows from the delivery means can vary, there must always exist a differential between adjacent flows of at least 5 f.p.m. and preferably over 20 f.p.m.

As has been previously mentioned, the apparatus 10 is in the form of a unit constructed from four modules 11. Referring now to FIG. 3, each module 11 is made of sheet metal and has a generally square top plate 17, an L-shaped base plate 18 and a rectangular perforated diffuser plate 13. Plate 13 has three distinct areas of different permeability (indicated by the variable cross-hatching at 19, 20, 21 in FIG. 2) to achieve the aforesaid different flow velocities. Each plate 13 is hinged at 22 (FIG. 1) to facilitate servicing and cleaning.

The module 11 has closed inner adjacent side walls 23, 24 and side walls 25, 26 each having an elongate inlet window 27. Parallel to these latter walls and along the inner edges of the L-shaped base plate extend internal walls 28 and 29 which help to define an inner compartment of the module and fan inlet chambers 30 and 31. Each inlet window is closed by a hinged panel 32 (FIGS. 1 and 2) carrying a pre-filter pad 33 for removing coarse contaminants from incoming air.

Figure 4:
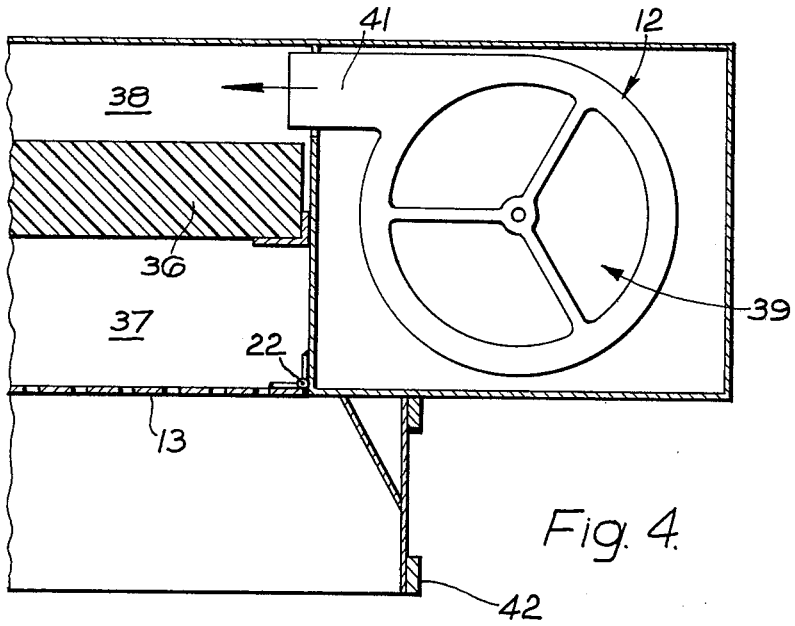
FIG. 4 is an enlarged fragmentary cross-section on the line IV—IV of FIG. 2, showing details of the fan.

The inner compartment of module 11 has a shallow sheet metal tray 34 therein which has apertures 35 and which supports filter pads 36. Below the tray 34 and above the plate 13 is a plenum chamber 37 and above the pads 36 and below top plate 13 is an intake chamber 38 to which air is supplied by fan 12 (FIG. 4). The fan 12 has been omitted from FIG. 3 for clarity.

Turning now to FIG. 4, it will be seen that each fan 12 is a conventional radial flow fan having two axial inlets 39 and 40 and a tangential outlet 41 which discharges into intake chamber 38. The inlets 39 and 40 face and take air from fan inlet chambers 30 and 31. The rotor and integral electric motor of the fan have not been illustrated as they form no part of the present invention.

Figure 1:
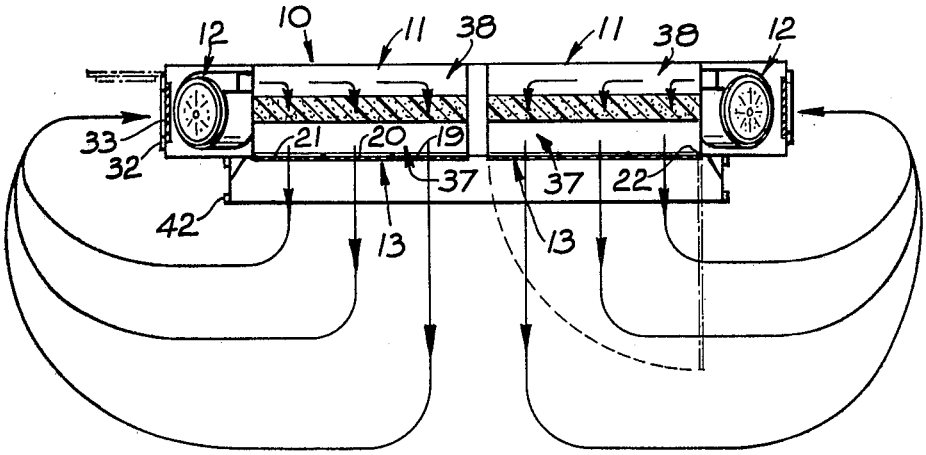
FIG. 1 is a transverse cross-sectional schematic view of a preferred apparatus of the invention, the cross-section taken on the line I—I of FIG. 2.

From the arrows in FIGS. 1 and 2 it will be appreciated that a basically re-circulating air system is employed, thus generating a clean zone beneath the air delivery means and a swept air zone surrounding the delivery means. This results in an effectively larger clean zone. The recirculating feature also means that the filters have to be replaced at less frequent intervals as they are not continuously filtering dirty ambient air as they would be in a non-circulatory system.

A short canopy 42 (FIG. 1) can be provided to give some guidance to the downwardly flowing air.

I claim:

1. Apparatus for providing a clean air zone comprising:

first and second and third adjacent air delivery means, each air delivery means being in the form of a rigid perforated panel having different permeabilities, a plurality of air supply means for supplying sterile air to the respective air delivery means, the first air delivery means being provided air at a first velocity, the second air delivery means being provided air at a second velocity lower than the first velocity, the third air delivery means being provided air at a third velocity lower than the second velocity.

2. Apparatus for providing a clean air zone comprising:

a plurality of air delivery means, a plurality of air supply means for supplying sterile air to the air delivery means, a first central one of the air delivery means being adapted to supply air at a first velocity, and a second outer one of the air delivery means being adapted to supply air at a second velocity lower than the first velocity, the different air delivery means having different permeabilities for attaining the desired flow velocity differential.

3. The apparatus of claim 2, wherein said air delivery means are in the form of perforated panels below a plenum chamber to which air is supplied by the air supply means.

4. Apparatus as set forth in claim 3 and in the form of a unit consisting of juxtaposed modules, each module having a plenum chamber and air supply means, together with a diffuser plate, said diffuser plate having areas of different permeabilities constituting the said panels.

5. Apparatus as set forth in claim 4, wherein each air supply means is a fan which discharges into an intake chamber separated from the plenum chamber by a filter.

6. Apparatus as set forth in claim 5, wherein each module has an inner compartment divided into said intake chamber and said plenum chamber and containing said filter, and an outer compartment containing the fan and at least one fan inlet chamber.

7. Apparatus as set forth in claim 6, wherein the inlet chamber has an inlet window closed by a pre-filter panel.

8. Apparatus as set forth in claim 7, wherein the pre-filter panel is hinged to allow access for servicing and cleaning.

9. Apparatus as set forth in claim 4, wherein the diffuser plate is hinged to allow access for servicing and cleaning.

* * * * *